US005509241A

United States Patent [19]

Coconis et al.

[11] Patent Number: 5,509,241

[45] Date of Patent: Apr. 23, 1996

[54] FIREPROOFING PANEL ATTACHMENT SYSTEM

[75] Inventors: John M. Coconis, Derry; John C. Solloway, Salem; George K. Castle, Hollis, all of N.H.

[73] Assignee: Avco Corporation, Providence, R.I.

[21] Appl. No.: 317,699

[22] Filed: Oct. 5, 1994

Related U.S. Application Data

[63] Continuation of Ser. No. 886,052, May 20, 1992.

[51] Int. Cl.[6] ..... E04C 2/00

[52] U.S. Cl. ..... 52/232; 52/511; 52/600; 52/787.11

[58] Field of Search ..... 52/232, 239, 600, 52/601, 511, 513, 489.2, 592.3, 309.2, 787, 541, 552, 591.1, 591.4, 489.1

[56] References Cited

U.S. PATENT DOCUMENTS

| | | | |
|---|---|---|---|
| 739,646 | 9/1903 | Carter | 52/513 |
| 799,843 | 9/1905 | Fisher | 52/513 |
| 833,532 | 10/1906 | Kuzmier | 52/513 |
| 957,382 | 5/1910 | Schnurr | 52/513 X |
| 1,014,416 | 1/1912 | Schweikert | 52/513 |
| 1,444,274 | 2/1923 | Rigdon | 52/600 |
| 2,097,988 | 11/1937 | Ross et al. | 52/511 X |
| 2,218,965 | 10/1940 | Young et al. | 72/67 |
| 3,142,938 | 8/1964 | Eberhardt | 52/511 X |
| 3,312,030 | 4/1967 | Gillespie | 52/497 |
| 3,849,178 | 11/1974 | Feldman . | |
| 3,872,636 | 3/1975 | Nicosia | 52/364 |
| 3,998,018 | 12/1976 | Hodges | 52/511 X |
| 4,414,674 | 11/1983 | Woodruff et al. | 52/511 X |
| 4,493,945 | 1/1985 | Feldman . | |
| 4,517,782 | 5/1985 | Shamszadeh | 52/309 |
| 4,529,467 | 7/1985 | Ward et al. | 52/232 X |
| 4,700,518 | 10/1987 | Akihama et al. | 52/600 X |
| 4,729,916 | 3/1988 | Feldman | 52/232 X |
| 4,804,299 | 2/1989 | Forte et al. | 52/600 X |
| 4,821,909 | 4/1989 | Hibler et al. | 52/232 X |
| 4,936,064 | 6/1990 | Gibb | 52/232 |

FOREIGN PATENT DOCUMENTS

| | | |
|---|---|---|
| 5978286 | 1/1990 | Australia . |
| 66979 | 12/1982 | European Pat. Off. . |
| 276175 | 7/1988 | European Pat. Off. . |
| 547727 | 12/1922 | France . |
| 1312849 | 11/1962 | France . |
| 2296502 | 7/1976 | France . |
| 1805968 | 6/1970 | Germany . |
| 1808187 | 9/1970 | Germany . |
| 7706793 | 6/1977 | Netherlands . |
| 19262 | 12/1909 | United Kingdom . |
| 879383 | 10/1961 | United Kingdom . |
| 904796 | 8/1962 | United Kingdom . |
| 973692 | 10/1964 | United Kingdom . |
| 1140345 | 1/1969 | United Kingdom . |
| 1358853 | 7/1974 | United Kingdom . |
| 1387141 | 3/1975 | United Kingdom . |
| 1413016 | 11/1975 | United Kingdom . |
| 1439282 | 6/1976 | United Kingdom . |
| 2231905 | 11/1990 | United Kingdom . |

OTHER PUBLICATIONS

Zola, J. C., "High Heat and Flame–Resistant Mastics", in *Fire Retardant Paints, Advances in Chemistry Series,* No. 9, American Chem. Soc., Washington, D.C. 1954.

*Primary Examiner*—Lanna Mai
*Attorney, Agent, or Firm*—Mary E. Porter

[57] ABSTRACT

A system for attaching fireproofing panels to a poured structure. The panels are made with projecting members. In use, the panels line a form with the projecting members facing inward. When the form is removed, the panels are embedded in the poured structure by virtue of the projecting members. The same bolts are used to secure the panels to the form and to secure the joints between panels after the forms are removed.

11 Claims, 3 Drawing Sheets

FIREPROOFING PANEL ATTACHMENT SYSTEM

This is a continuation of application Ser. No. 07/886,052 filed on May 20, 1992.

BACKGROUND

This application relates generally to fireproofing products and more specifically to fireproofing panels.

Fireproofing is an important segment of an overall fire protection system to protect people and property. The fireproofing is applied over some type of substrate. Typically, fireproofing is applied to structural members in areas where a fire can occur. In the event of fire, fireproofing will retard the rate of temperature increase in the structural members such that the failure temperature of the members can be delayed for as much as several hours. During the period of delay, the fire may be extinguished or, at the least, the structure can be safely evaluated. When no fireproofing is used, structural members have been known to fail, thus resulting in structure collapse, in less than 15 minutes.

Fireproofing is also applied to elements such as walls, bulkheads, or decks. In a fire, the fireproofing delays an increase in temperature behind the element. Where inflammable material is stored behind the element, the fireproofing can prevent ignition of the material, hopefully until the fire is extinguished.

Fireproofing is also applied to pressure vessels. The fireproofing reduces the possibility that the vessel will rupture. Thus, the fireproofing reduces the chance of explosion or release of hazardous material from the vessel.

Fireproofing is also used over cable trays. The fireproofing can keep the circuitry in the tray functioning for an extended period of time in the event of a fire.

One widely used type of fireproofing is a char-forming coating. The coating can be called ablative, subliming, or intumescent. As supplied, these coatings can be in the form of a low viscosity paint or a high viscosity mastic. These coatings are sprayed or troweled or brushed on to a substrate.

Some of these coatings are used in combination with a mesh element. Some coatings utilize a flammable mesh, others a nonflammable mesh such as one fabricated from steel. With some coatings, the mesh is mechanically mounted on the substrate; with others, it is simply embedded in the coating.

When these coatings are exposed to a fire, they undergo a number of changes of state—solid to liquid, liquid to gas, and solid to gas—absorbing some of the energy of the fire, and insulating the substrate. Fire exposure results in the formation of a char which, depending on the material, can be thicker, as thick, or less thick than the thickness of the non-fire exposed coating.

The above-mentioned mesh element may perform one or more functions. Mesh might be used to retain char on the substrate during a fire. It also reduces the mismatch in coefficient of thermal expansion between the fireproof coating and the substrate, such as steel or concrete. It thus serves to keep the coating from peeling off the substrate, especially in environments where the temperature cycles through a large range. In other instances, the mesh reinforces the fireproofing prior to a fire to reduce damage to the coating of fireproofing which could be caused by impact or movement of the substrate.

One example of a fireproofing compound which forms a char is CHARTEK intumescent epoxy coating sold by Textron Specialty Materials of Lowell, Mass., USA. Other such materials are described in U.S. Pat. No. 3,849,178 issued to Feldman.

It has been suggested that the cost of installing fireproofing could be reduced if the substrate were covered with fireproofing panels. Panels could be installed without the special equipment needed to apply coatings of fireproofing material. Also, surface preparation needed before a coating can be applied could be eliminated if panels were used. Further, a coating can be applied to an outside structure only if weather conditions are favorable while the coating is applied and is curing. Installation of panels is much less dependent on weather conditions.

Panels made of fireproofing material similar to concrete are commercially available. For example, U.S. Pat. No. 4,567,705 to Carlson describes such panels. To protect a substrate, steel studs are welded to the substrate in a predetermined pattern. The stud positions match holes in the panels. The panels are then mounted on the studs and bolted to the substrate.

To cover a substrate larger than a single panel, many panels are mounted to the substrate. The panels are butted together. The space between the panels is caulked to provide a barrier to moisture. The panels are, however,very heavy and are difficult to install in some places. Also, such panels are not used where the fireproofing must have an A or a H rating.

Lightweight pieces made from char forming compounds have also been suggested. U.S. Pat. No. 4,493,945 shows lightweight pieces of fireproofing material used to cover a substrate. Relatively complicated fastening mechanisms are employed. Moreover, it is necessary to still use char-forming compound in its liquid (mastic) form to seal the seams between pieces.

The pieces shown in U.S. Pat. No. 4,493,945 have also been formed as panels. The panels are attached to walls or large substrates by bolting them to studs mounted to the substrate. The joints between panels and the bolts are then covered by char-forming compound in liquid form.

While there are many advantages to using panels, suitable methods to install fireproofing panels to some structures have not been developed. For example, some offshore platform decks used by the hydrocarbon industry rest on a small number of concrete joists or beams. These platform decks are used in oil or gas drilling or for hydrocarbon processing. To support the weight of the platform deck, each joist has a cross section over 25 feet square. The joists are traditionally cast in a ship building yard and then floated to the site where the oil drilling platform is to be installed.

To provide high strength but low weight, the joists are made with specially modified concrete. While concrete is generally resistant to fire and in some circumstances is even used as a fireproofing material, this specially modified concrete may be weakened in a fire. Also, because of the serious consequences if a beam or joist fails, it is desirable to place fireproofing over the concrete to help prevent the reinforcing metal inside the joist from reaching its failure temperature.

Because of the large size of these joists and because of the location of the joists below the oil drilling platform deck, it is difficult to apply fireproofing to these joists.

SUMMARY OF THE INVENTION

With the foregoing background in mind, it is an object of this invention to provide fireproofing panels which can be easily installed.

It is also an object to provide fireproofing panels which can cover a large substrate.

It is also an object to provide fireproofing panels which can be secured to a concrete substrate.

The foregoing and other objects can be achieved by a fireproofing panel having a projecting member connected thereto. To attach the panels to a poured substrate, the forms for pouring the substrate are lined by panels with their projecting members facing inward. The substrate is then poured into the form, resulting in the projecting member being embedded in the substrate.

According to one embodiment of the invention, the panels are bolted to the side of the form before the substrate is poured into the form. After the forms have been removed from the substrate, the bolts may also be used to secure the joints between adjacent panels.

According to another embodiment of the invention, the fireproofing panels are made by molding a sheet of open wire mesh in fireproofing material. The projecting member is formed by inserting a clip which engages the mesh.

BRIEF DESCRIPTION OF THE DRAWINGS

The invention will be better understood by reference to the following detailed description and accompanying drawings in which.

DESCRIPTION OF PREFERRED EMBODIMENT

Figure 1:
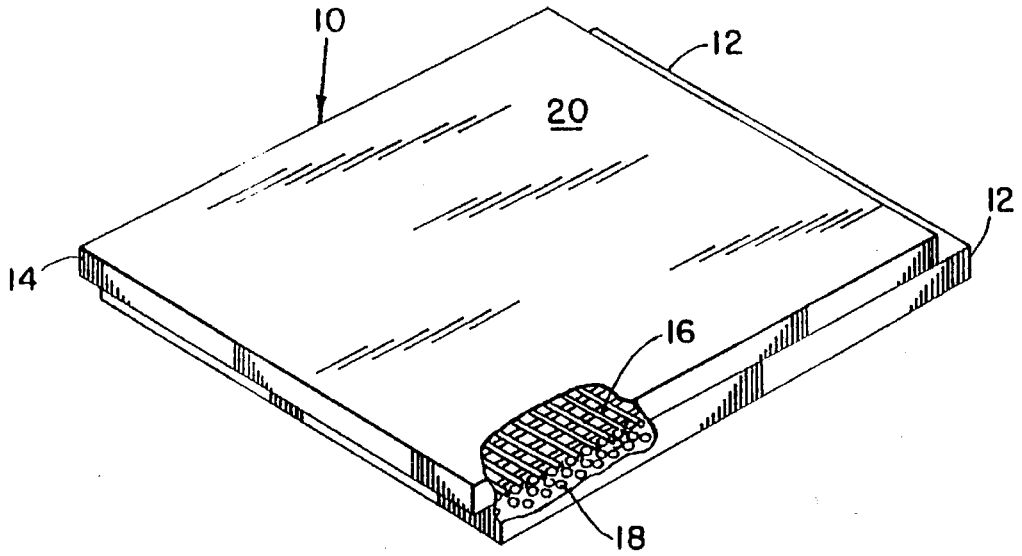
FIG. 1 is an isometric view of a fireproofing panel, partially cutaway.

FIG. 1 shows a fireproofing panel 10 fabricated according to the invention. Fireproofing panel 10 is molded from a known fire-proofing coating material as described in greater detail below.

Fireproofing panel 10 has a ledge 12 along two edges. There is an overhang 14 along the other two edges. When two fireproofing panels are placed side by side with the same orientation, ledge 12 of one panel and overhang 14 of the other panel interlock to form a lap joint.

Embedded in fireproofing panel 10 is a wire mesh 16. Here wire mesh 16 is an open mesh with a one half inch by one half inch (12.7 mm by 12.7 mm) opening formed from 19 swg wire. Wire mesh 16 reinforces the cured fireproofing material before a fire. During a fire, mesh 16 reinforces the char once it forms. Of course, other sizes and types of mesh could be used for these purposes. Expanded metal, chicken wire, hardware cloth, and perforated metal are all examples of materials that could be used. As used herein, the term "mesh" refers generically to any such material with numerous openings in it.

Also embedded in fireproofing panel 10 is a second piece of mesh. Here, that mesh is perforated metal 18. Unlike wire mesh 16, perforated metal 18 is disposed in only a portion of fire protecting panel 16. Namely, perforated metal 18 is disposed only in ledge 12.

When fireproofing panel 10 is mounted to protect some substrate (not shown) from fire, front surface 20 faces away from the substrate. When multiple fireproofing panels are mounted to form lap joints, perforated metal 18 of one of the panels will always be at the rear of the lap joint. A bolt (bolt 302, FIG. 3) will pierce wire mesh 16 on one panel and perforated metal 18 of the other panel. Thus, the two panels will be held tightly together at the lap joint by the bolt (bolt 302, FIG. 3). Here, perforated metal 18 is 22 gauge perforated metal with 3/32" (2.4 mm) round holes on 5/32" (4.0 mm) centers is used. Other perforated metals could be used, but perforated metal no less dense than metal with 3/16" (4.8 mm) holes on ¼" (6.4 mm) centers is preferred. If more dense perforated metal is used, there must be enough holes in the perforated metal to allow the fireproofing material to flow through the perforated metal during molding and ensure that perforated metal 18 is strongly bonded to the panel.

Figure 2:
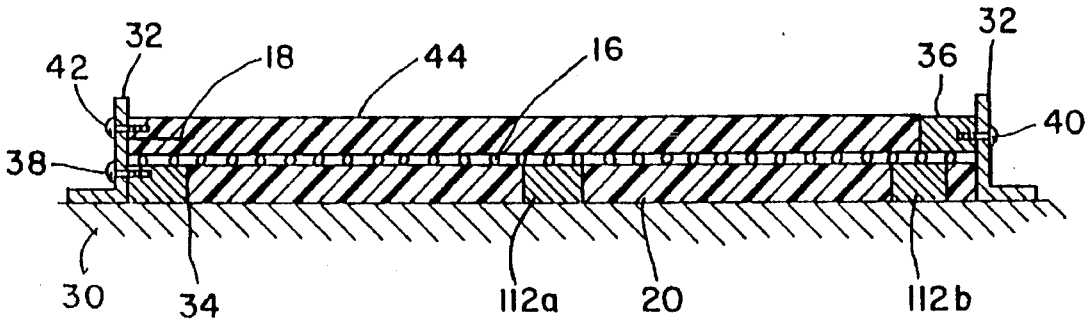
FIG. 2 cross sectional view of a mold used to form the panel of FIG. 1.

Turning now to FIG. 2, a mold for forming fireproofing panel 110 is shown. The mold is formed on a table or other suitable base 30. Angle brackets 32 are mounted to table 30. Screws, clamps or any convenient mounting means could be used. Angle brackets 32 define the boundaries of fireproofing panel 10. Fireproofing panels are made to any convenient size. Here, the panels are squares roughly three feet (0.9 m) on a side. Thus, angle brackets 32 are mounted totable 30 to form a three foot square.

During fabrication, shoulder 34 is placed into the mold along each edge which will have a ledge 12 (FIG. 1). Shoulder 34 is made from metal, plastic, or wood and secured in place by pin 38, or by some other convenient method such as screws. The pieces of the mold are coated with a commercially available mold release product. Alternatively, the mold could be coated with TEFLON.

Next, spacer blocks 112*a* and 112*b* are placed in the mold. Spacer blocks 112*a* and 112*b* hold mesh 16 away form surface 20. The thickness of spacers 112*a* and 112*b* is not critical. They should be approximately half the thickness of the finished panel.

As spacer blocks 112*a* and 112*b* become part of the finished panel, they are made from fireproofing material. The fireproofing material can be molded into the desired sizes of spacer blocks 112*a* and 112*b*. Alternatively, it can be molded in a sheet and cut to the right size after curing. A suitable material is also described in U.S. Pat. No. 4,529,467, but many commercially available fireproofing products are acceptable.

Next, a fireproofing material is poured into the mold until the fireproofing material comes roughly to the top of shoulder 34. The material is any known fireproofing material which is conventionally applied in a liquid state and then cures.

Next, wire mesh 16 is laid into the mold. Also, shoulder 36 is placed into the mold and held in place by pin 40. Shoulder 36 holds one edge of wire mesh 16 in place.

A shoulder 36 is placed along each edge which does not already contain a shoulder 34. The portion of panel 10 under shoulder 36 forms overhang 14.

Next, more fireproofing material 44 is added to the mold to cover wire mesh 16. Perforated metal 18 is placed into the mold over shoulder 34. Pin 42 is inserted to ensure perforated metal 18 remains embedded in the fireproofing material 44. The mold is then filled with fireproofing material to the top of shoulder 36.

The fireproofing material 44 is then smoothed by troweling or by vibrating table 30. The fireproofing material 44 does not need to be completely smooth since the surface of the top of the mold will be mounted facing a substrate and will not be visible. In contrast, upper surface 20 (FIG. 1) is the surface against table 20. That surface will be smooth.

The fireproofing material is then allowed to cure. The material might be allowed to air dry or the curing could be accelerated by placing the entire mold in an oven. When cured, the panel can be removed from the mold.

Panel 10 may be modified to include a plurality of projecting members to facilitate attachment of panels to poured surfaces. The projection may be formed in any number of ways such as screwing or cementing strips of metal or mesh to the back of the panels. Alternatively, the sheets of perforated metal or mesh inside the panel could be bent outward prior to filling the mold with fire proofing material. A preferred method of forming projections in the panels is shown in FIG. 3.

Figure 3:
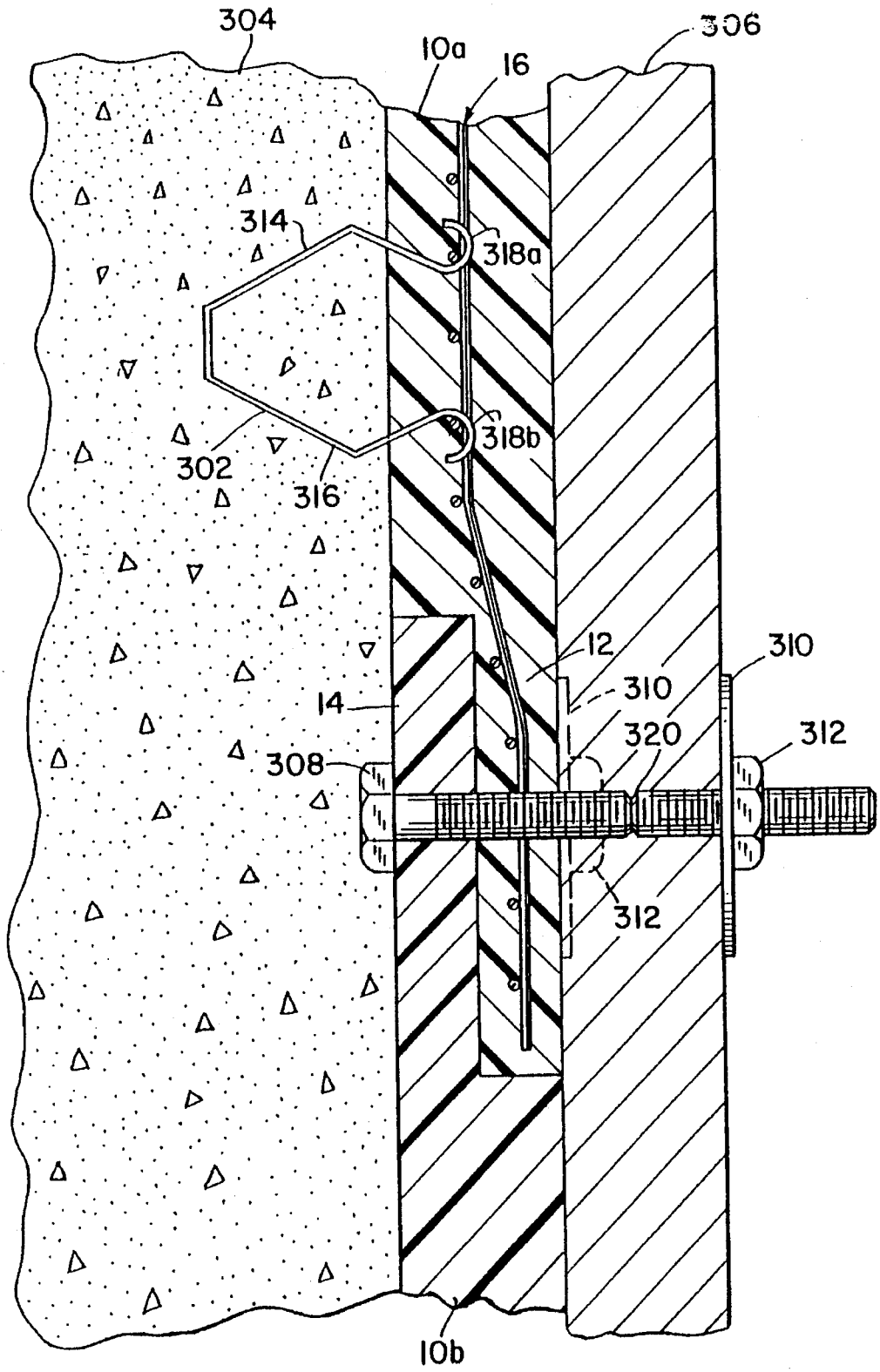
FIG. 3 is a crysectional view of a panel attachment mechanism.

FIG. 3 shows a spring clip 302 inserted in the panel during the molding operation. The clip engages a portion of the panel, such as mesh 16 in the panel. Clip 302 is made from a resilient material, such as stainless spring steel. During the manufacturing operation, sides 314 and 316 of clip 302 and be squeezed together, allowing ends 318*a* and 318*b* to fit into an opening in mesh 16. Once clip 302 is inserted far enough into panel 10 to have ends 318*a* and 318*b* pass through mesh 16, sides 314 and 316 are released. Due to the resilient nature of clip 302, sides 314 and 316 will spread apart, coming in contact with mesh 16. As clip 302 is pulled out of the panel, the curved portions of ends 318*a* and 318*b* will engage mesh 16. When the material used to make panel 10 cures, clip 302 will be firmly attached to panel 10 and will have a projecting portion.

Copending U.S. patent application Ser. No. 07/690,519 filed Apr. 24, 1991 for a Fireproofing Panel System (which is hereby incorporated by reference) describes that a foil sheet may be pressed into the back of a panels while the panel is being molded. In addition to the benefits described in the aforementioned patent application, such a foil sheet may be desirable to separate the fireproofing material of the panel from moisture which might be retained in the poured material of the structure. If such a sheet is used, it should be applied as described in the aforementioned application and then slit to allow insertion of clips 302.

The number of clips inserted in panel 10 must be selected based on the type of material to which panel 10 will be attached and the weight of panel 10. Several clips per panel are preferred with at least one on each corner of the panel. Larger panels will require more clips.

Figure 4:
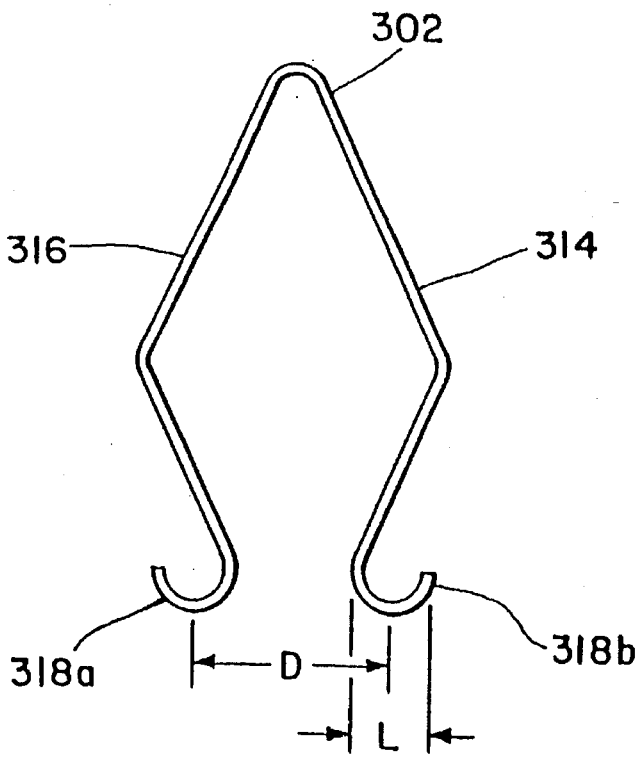
FIG. 4 is a sketch of a clip used to make the panel attachment mechanism of FIG. 3.
Figure 4A:
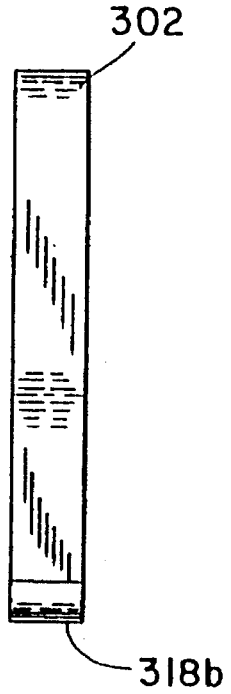
FIG. 4A is a side view of the clip of FIG. 4.

FIG. 4 shows in greater detail a preferred embodiment of clip 302 useful with a panel having a mesh reinforcement. Clip 302 may be formed from a 0.25 inch wide strip of 12 gauge stainless spring steel bent to the desired shape. For engaging a mesh, the dimension D is selected to be approximately the width of two openings such that the clip will engage mesh 16 as shown in FIG. 3. The dimension L is selected to be greater than one half of the width of one opening in the mesh. This spacing ensures that ends 318*a* and 318*b* of clip 302 are inserted into adjacent openings in the mesh rather than the same opening. The dimensions shown are illustrative of dimensions useful for panels with one half inch openings. Other dimensions could be used and should be selected according to known design techniques to result in a clip which can be easily manufactured.

Turning back to FIG. 3, FIG. 3 shows how panels may be affixed to the outer surface of a poured structure. Such structures are traditionally made by constructing forms in the desired shape. The material, such as concrete is then poured into the form and allowed to cure. After the material cures, the forms are removed.

To attach fireproofing panels to the structure, the inside of the form is lined with fireproofing panels before concrete is poured into the form. The panels must be held tightly against the form to ensure that they are on the outer surface of the concrete when the forms are removed. Here, panels, such as panels 10*a* and 10*b*, are overlapped at their portions 12 and 14, respectively. A hole is then drilled through the overlapping portion of the panels and through form 306. Bolt 308 is inserted through the hole and secured with washer 310 and nut 312. The inside of form 306 is lined with panels in this fashion in all regions where fireproofing is desired. Concrete, or other structural material, is then poured into the form.

As shown in FIG.3, clip 302 projects into the concrete 304. When the concrete cures, panels 10*a*, 10*b*, etc. are firmly attached to concrete 304. Nut 312 and washer 310 can be removed. Form 306 can then be removed.

Washer 310 and nut 312 can then be replaced on bolt 308. In this configuration, bolt 308 holds the joint between panels 10*a* and 10*b* tightly closed. If desired, the excess potion of bolt 308 may be cut off at line 320. The joint between panels 10*a* and 10*b* can be caulked with a weather resistant caulk to help prevent moisture from reaching the structure.

To make it easier to ship panels containing projecting members, the projecting members could be made of material that can be bent flat against the surface of panel 10. The spring steel described above is suitable for this purpose, but a wide variety of other materials could be used. In this way, the projecting members could be bent down after the panels cure to allow transportation to the job site. Also, the projections will not be in the way when the panels are affixed to the form. Prior to pouring the concrete, the projecting members can then be bent into position.

Having described preferred embodiments of the invention, various alternative embodiments will be apparent to those of skill in the art. The shape and placement of the projecting member could be changed to make it easier to produce the clips. For example, wire ribbon or some other convenient material could be used to form the projecting member. Further, the projecting members could be formed in a wide variety of shapes. For example, the projecting member could be made with a larger portion embedded in the poured material. Moreover, the projecting member does not have to be formed from a closed loop as shown in the preferred embodiment.

Attachment mechanisms besides bolt 308 could be used. Further, if panels without lap joints are used, there will be no need to refasten the nuts on bolts 308 as the panels will be held in place by the projecting member embedded in the poured substrate material. The exposed portion of bolt 308 might be cut off in these cases.

A further alternative embodiment could be formed by incoporating a projecting member onto bolt 308. With this configuration, the projecting members could be omitted on the fireproofing panels. The panels would be held to the substrate solely by the bolts.

Other alternative embodiments may be formed by using the fireproofing panel attachment system with other types of substrates. Poured concrete was used as an example for the purposes of illustration only. Any type of poured substrate material could be protected in this fashion.

What is claimed is:

1. A preformed, integral fireproofing panel, having at least one substantially planar surface, and adapted to be attached to a substrate to be fireproofed, comprising:

a. a region of intumescent fireproofing material; and b. a projecting member having an end embedded within the region of fireproofing material and connected to a planar surface of the fireproofing panel and having another end extending orthogonally away from the region of fireproofing material for attaching the fireproofing material to the substrate;

wherein the panel comprises a sheet of mesh embedded in the fireproofing material and the embedded end of the projecting member is attached to the mesh.

2. The fireproofing panel of claim 1 wherein the projecting member comprises a shape bent from a sheet of metal.

3. The fireproofing panel of claim 1 wherein the projecting member comprises a spring clip interlocking the mesh.

4. The fireproofing panel of claim 1 wherein the projecting member is sufficiently pliable to be bent against the planar surface and returned to the orthogonal position.

5. The fireproofing panel of claim 1 wherein the panel also comprises a sheet of perforated metal embedded in the fireproofing material.

6. The fireproofing panel of claim 1 preformed in rectangular shape with molded lap joints comprising overhang areas along two edges thereof and ledge areas along the other two edges thereof, the overhang areas of one panel being adapted to overlie the ledge areas of an adjacent panel to provide lap joints and avoid the formation of open spaces between adjacent fireproofing panels.

7. The fireproofing panel of claim 6 wherein the panel also comprises a sheet of perforated metal embedded in the fireproofing material in the ledge areas thereof.

8. A method of making an integral fireproofing panel, having at least one substantially planar surface, and adapted to be attached to a substrate to be fireproofed, comprising the steps of:

a. disposing curable, intumescent fireproofing material in the shape of the panel;

embedding a sheet of mesh in the fireproofing material;

b. inserting a projecting member into the intumescent fireproofing material such that one end of the projecting member is embedded in the fireproofing material and a portion of the projecting member projects from the fireproofing material in a substantially orthogonal direction from a planar surface of the fireproofing panel, engaging the embedded end of the projecting member with the mesh, and c. curing the material to form the fireproofing panel having the projecting member embedded therein.

9. The method of claim 8 wherein the step of disposing fireproofing material also comprises embedding a sheet of perforated material in the fireproofing material.

10. The method of claim 8 wherein the step of disposing curable fireproofing material in the shape of the panel comprises molding said material in rectangular shape with overhang areas along two edges thereof and ledge areas along the other two edges thereof, to provide lap joints between adjacent panels.

11. The method of claim 10 wherein the step of disposing fireproofing material also comprises embedding a sheet of perforated material in said ledge areas.

* * * * *